US009238885B2

(12) United States Patent
Di Bono et al.

(10) Patent No.: US 9,238,885 B2
(45) Date of Patent: Jan. 19, 2016

(54) DETERGENT DISPENSING DEVICE

(75) Inventors: Giuseppe Di Bono, Mira (IT); Nicola Pretto, Mira (IT)

(73) Assignee: Reckitt Benckiser N.V., WT Hoofddorp (NL)

( * ) Notice: Subject to any disclaimer, the term of this patent is extended or adjusted under 35 U.S.C. 154(b) by 1083 days.

(21) Appl. No.: 13/322,627

(22) PCT Filed: May 24, 2010

(86) PCT No.: PCT/GB2010/001025
§ 371 (c)(1),
(2), (4) Date: Mar. 2, 2012

(87) PCT Pub. No.: WO2010/139928
PCT Pub. Date: Dec. 9, 2010

(65) Prior Publication Data

US 2012/0151971 A1 Jun. 21, 2012

(30) Foreign Application Priority Data

Jun. 1, 2009 (GB) ..... 0909363.4

(51) Int. Cl.
*D06F 39/02* (2006.01)
*A47L 15/44* (2006.01)

(52) U.S. Cl.
CPC ..... *D06F 39/024* (2013.01); *A47L 15/4445* (2013.01)

(58) Field of Classification Search
CPC ..... D06F 39/024; D06F 39/02; D06F 39/022; D06F 39/026; A47L 15/4445; A47L 15/4436; A47L 15/4472
USPC ..... 68/17 A
See application file for complete search history.

(56) References Cited

U.S. PATENT DOCUMENTS

| | | | | |
|---|---|---|---|---|
| 3,215,311 | A | 11/1965 | Ludwig | |
| 6,301,734 | B1 | 10/2001 | Dunsbergen et al. | |
| 2010/0170302 | A1* | 7/2010 | Housmekerides et al. | ... 68/17 R |

FOREIGN PATENT DOCUMENTS

| | | | |
|---|---|---|---|
| DE | 19934593 | A1 | 1/2001 |
| EP | 1329188 | A1 | 1/1985 |
| EP | 1200664 | A1 | 5/2002 |
| GB | 2427397 | A | 12/2006 |
| WO | 0107704 | A1 | 2/2001 |

OTHER PUBLICATIONS

International Search Report, and Written Opinion for application PCT/GB2010/001025 dated Sep. 8, 2010.
Combined Search and Examination Report for priority application GB0909363.4 dated Aug. 1, 2009.
English Language translation of application WO0107704 taken from esp@ce.net.
English Language translation of application EP0132188 taken from esp@ce.net.
English Language translation of application DE 19934593 taken from esp@ce.net.
* cited by examiner

*Primary Examiner* — Michael Barr
*Assistant Examiner* — Rita Adhlakha
(74) *Attorney, Agent, or Firm* — Norris McLaughlin & Marcus PA

(57) ABSTRACT

A detergent composition dispensing device removable insertable into a washing machine comprises:—
(a) a primary chamber to accommodate a detergent composition,
(b) a secondary chamber, for releasing same into the wash liquor of the washing machine,
(c) a mechanism for transferring detergent from the primary to the secondary chamber, the mechanism comprising:
(i) a movable piston disposed within the secondary chamber
(ii) a valve arranged between the primary chamber and the secondary chamber, which, when operated, permits flow of the detergent composition there-between.

14 Claims, 6 Drawing Sheets

DETERGENT DISPENSING DEVICE

This is an application filed under 35 USC 371 of PCT/GB2010/001025.

The present invention is related to a detergent dispensing device, particularly for dispensing said detergent into an automatic washing machine over a plurality of cycles.

In automatic machines, the detergent, whether in powder, tablet or gel form, is usually filled manually by the user into the machine, in particular into a detergent holder, before each washing operation.

This filling process is inconvenient, with the problem of exact metering of the detergent and possible spillage thereof, for powder and gel detergents. Even with detergents in tablet form, wherein the problem of accurate dosing is overcome, there is still the necessity of handling the washing detergent every time a washing cycle is started. This is inconvenient because of the usually aggressive and irritant nature of detergent compositions, because of the time wasted in the operation and because of the need to store the detergent separately from the automatic machine.

A number of devices are known for holding unit doses of a detergent composition or additive, such as detergent tablets, and for dispensing of such unit doses into a machine.

WO 01/07703 discloses a device for the metered release of a detergent composition or additive into a washing machine having a number of separate sealed chambers for holding the detergent composition or additive and means for piercing the chambers, activated by conditions within the machine.

The reliable operation of this type of device is limited by the complication of the dispensing and indexing mechanism and by the variability of the actuation means described in the patent, like weight of the load or rotation of the drum.

WO 03/073906 discloses a free standing device for dispensing multiple doses of detergent into a dishwasher. The device has a plate-like construction. A round blister pack having a plurality of doses arranged around its periphery is loaded into the pack. A winder is then rotated to load mechanical energy into the device sufficient to dispense more than one dose of detergent. A thermally operated latch then moves when the device is subjected to the elevated temperatures within the dishwasher and, in cooperation with a ratchet mechanism, moves the blister pack so that the next dose of detergent is ready for dispensing. In order to dispense the detergent, either the blister pack is pierced, or the dose is ejected from its compartment within the blister pack.

WO 03/073907 discloses a similarly shaped free standing dispensing device. In order to dispense detergent, a lever is manually operated to move a blister pack either to eject the detergent from a compartment within the blister pack, or to pierce the blister pack. A door or flap initially prevents wash liquor within the machine from accessing the exposed detergent. A bi-metallic strip is provided to move the door or flap when the device is exposed to the elevated temperatures during a washing cycle to allow access of the wash liquor to the exposed detergent thereby dispensing the detergent to the machine.

Both these devices have some serious limitations:

a) complicated dispensing and indexing mechanism,
b) they require the direct intervention of the user to operate, therefore reducing the time saved by using them
c) they depend on temperature for the dispensing of the dose and temperature gradients are not reliable triggers in laundry washing cycles, since the temperature of the wash can be selected by consumers between cold water and 90° C.

Other devices have been described such as in WO-02/29150 which measure a condition of the wash cycle and use this condition to trigger the release of a dose of a washing active, e.g. a washing detergent into a washing machine. One condition which is exemplified in this document is conductivity of the wash liquor, which can be used as an indication of the presence of water. However, the simple measurement of the presence of water is by no means a solution to the problem of the timing of the dose and the amount of dose of the washing active in the wash cycle. This is because false readings can occur, caused by, for example, dampness (wherein the dampness arises before the washing commences) of the washing being washed. Also in horizontal drum washing machines due to the level of fill of the drum with water and due to the rotation of the drum a device placed in a drum (and associated sensor), wherein the drum contains wash liquor, is not necessarily in contact with the wash liquor during all of the time. This can also give a false reading on the presence of water with associated incorrect detergent dosing.

The present invention is related to a development of these dispensing devices and overcomes the limitations described above.

According to a first aspect of the present invention there is provided a detergent composition dispensing device removable insertable into a washing machine, the device comprising:—

(a) a primary chamber to accommodate a detergent composition,
(b) a secondary chamber, for releasing same into the wash liquor of the washing machine,
(c) a mechanism for transferring detergent from the primary to the secondary chamber, the mechanism comprising:
  i) a movable piston disposed within the secondary chamber
  ii) a valve arranged between the primary chamber and the secondary chamber, which, when operated, permits flow of the detergent composition there-between.

The present invention is advantageous because it ensures that no under/over-dosage of detergent is applied by a user. Additionally any direct contact with the detergent composition (and any chemicals therein) is obviated. Furthermore the detergent is dosed directly into the heart of the automatic washing machine.

Preferably the device is for use in an automatic laundry washing machine.

Generally the piston is manually operated, e.g. by a user.

Preferably the piston comprises a plurality of parts. In a preferred embodiment the piston comprises two parts: a main piston body and a detachable plug.

Ideally the detachable plug seals the primary chamber (when engaged with the primary chamber).

Preferably the plug comprises the valve (between the cylinder and the secondary chamber to permit flow of the detergent composition there-between).

Preferably the plug is releasable attached to the main piston body by an attachment mechanism, such as a resilient hooking means.

Preferably the plug is releasable attached to the primary chamber. Generally the plug is releasably attached to a conduit between the primary and secondary chambers. When in place the plug seals the conduit.

Preferably the hooking means operates such that when activated the main piston body pushed towards plug and the hooking means engages. Then as the main piston body moves back to its initial position it (via the releasable attachment to the plug) is able to pull the plug away from its engagement and sealing of primary chamber. Thus preferably in the retreat of the piston and the plug the cylinder is filled with detergent composition from the primary chamber. Preferably as the main piston body reaching its initial position the hooking means dis-engaged. This is preferably achieved by contact with disengaging member arranged on the inside of the cylinder.

Preferably the secondary chamber is apertured. This use of apertures allows egress of the detergent composition into the water liquor. Alternatively the apertures allow washing out of the detergent composition by ingress (and subsequently egress) of the wash liquor. Most preferably the apertures are one-way valves such that egress of detergent is permitted whilst allowing effective operation of the piston. Alternatively/additionally the cylinder for the piston (which may be a separate sub-structure within the secondary chamber) has a (conical) flaring (e.g. at the end furthest from the primary chamber). The conical flaring (widening) of the cylinder means that the full bore of the cylinder is not obscured by the main piston body. Instead there is a gap between the main piston body and the bore of the cylinder at the end furthest from the primary chamber. The presence of this gap allows the detergent composition to seep out of the cylinder and/or (in use) wash liquor to seep into the cylinder aiding/causing removal of the detergent composition from the cylinder and through the secondary chamber into the main volume of wash liquor.

Generally the piston is biased into its initial position by a biasing member such as a spring.

Preferably the detachable plug is biased away from main piston body by a biasing member such as a spring.

Usually the pump is disposed within the secondary chamber.

It is preferred that the piston has a cap which is operable by a user. Ideally the operation comprises application of pressure to the cap towards the secondary chamber leading to/causing depression of the main piston body).

Optionally the piston cap has an indication means to show a user how many times the cap has been operated and (conversely) how many detergent doses remain available.

Preferably the indication means comprises a viewing window in the cap and a rotating counter wheel (generally with numerical indicia arranged thereon) arranged to rotate under the cap. Rotation of the counter wheel is preferably caused by engagement of profiled teeth on counter wheel and/or an outer edge of piston. (A preferred arrangement is one similar to the one used for extension/retraction of the ink cartridge in a common ball-point pen). Ideally the teeth are arranged to cause rotation of the counter wheel by 360° divided by the number of expected uses of the device. Normally the device is intended to be used 10 or 12 times and thus the counter wheel preferably rotates 30° or 36° per operation.

It is preferred that when the device is empty, e.g. after a plurality of uses, it can be refilled by a user. A preferred mode of refilling comprises the insertion/replacement of a pouch containing detergent within the primary chamber. Ideally the pouch is configured so that it can be arranged in fluid communication with the cylinder. In order to achieve this replacement it is preferable that the first and second chambers may be separated by a user. A suitable mode of separation/re-attachment comprises a screw-thread on one of the chambers. In this way the chambers can be separated by un-screwing the first chamber from the second chamber.

It is preferred that the indication means (if present) can be reset after the device has been refilled.

The detergent most preferably comprises an automatic laundry detergent. Most preferably the detergent comprises a liquid. In the context of the present invention the term liquid can be taken to include solidified gels/suspensions as well as conventional liquids.

The detergent formulation typically comprises one or more of the following components; builder, co-builder, surfactant, bleach, bleach activator, bleach catalyst, enzyme, polymer, dye, pigment, fragrance, water and organic solvent.

Optionally the detergent comprises a detergent additive. It will be appreciated that a detergent additive when compared to a detergent may be required during a different section of the wash cycle (e.g. such as the rinse cycle for a rinse aid detergent additive).

According to a second aspect of the invention there is provided a method use of the device as described in the first aspect of the invention in the discharge of detergent during a laundry washing operation.

Generally the method leads to the detergent being dispensed in the main wash and/or the last rinse step of the washing cycle.

The invention will now be described with reference to the following non-limiting Figures which illustrate the invention.

Figure 1:
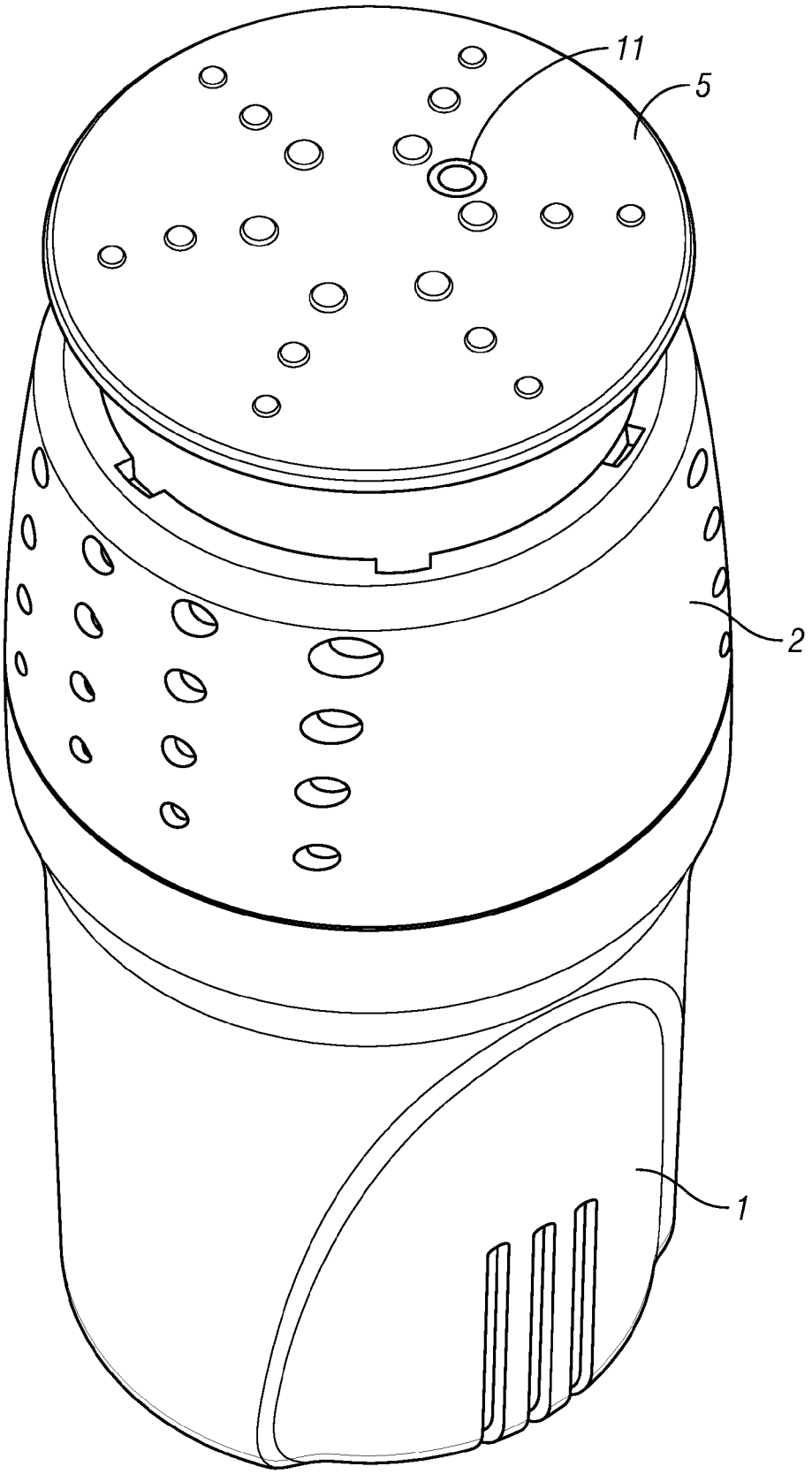
FIG. 1 shows a top view of an embodiment of a device in accordance with the invention.
Figure 2:
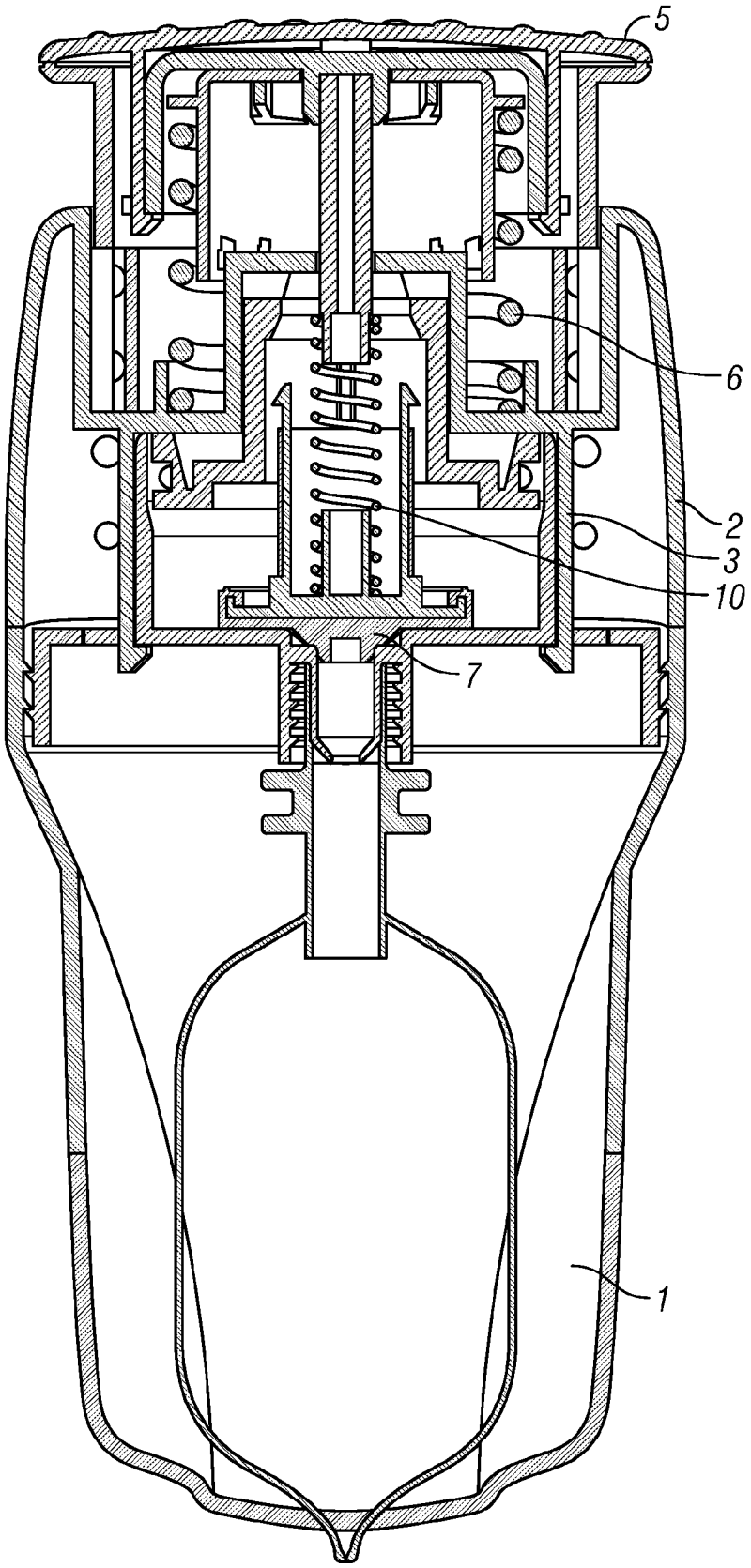
FIG. 2 shows a cross-sectional view of an embodiment of a device in accordance with the invention.

The device comprises a primary chamber 1 designed to retain a volume of detergent composition and a secondary chamber 2 designed to release a portion of the detergent composition in a washing operation in an automatic washing machine.

Preferably the secondary chamber 2 is apertured to allow egress of the detergent composition into the water liquor and/or washing out of the detergent composition by the wash liquor.

The secondary chamber 2 includes a pump. The pump comprises a cylinder 3 having a main piston body 4. The pump is manually operable by a user pressing on the piston cap 5.

Figure 3A:
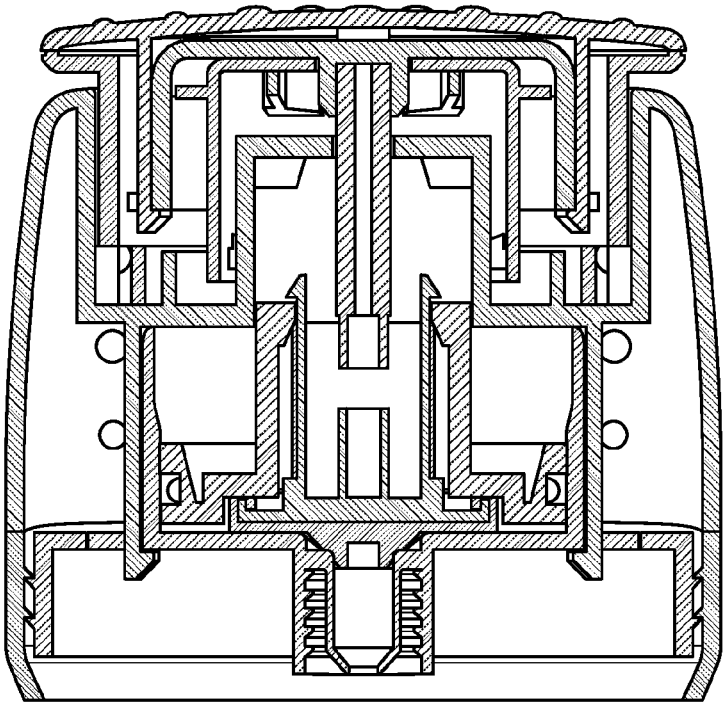
FIGS. 3A, 3B, 4A and 4B show close-up cross-sectional views of an embodiment of a device in accordance with the invention.
Figure 3B:
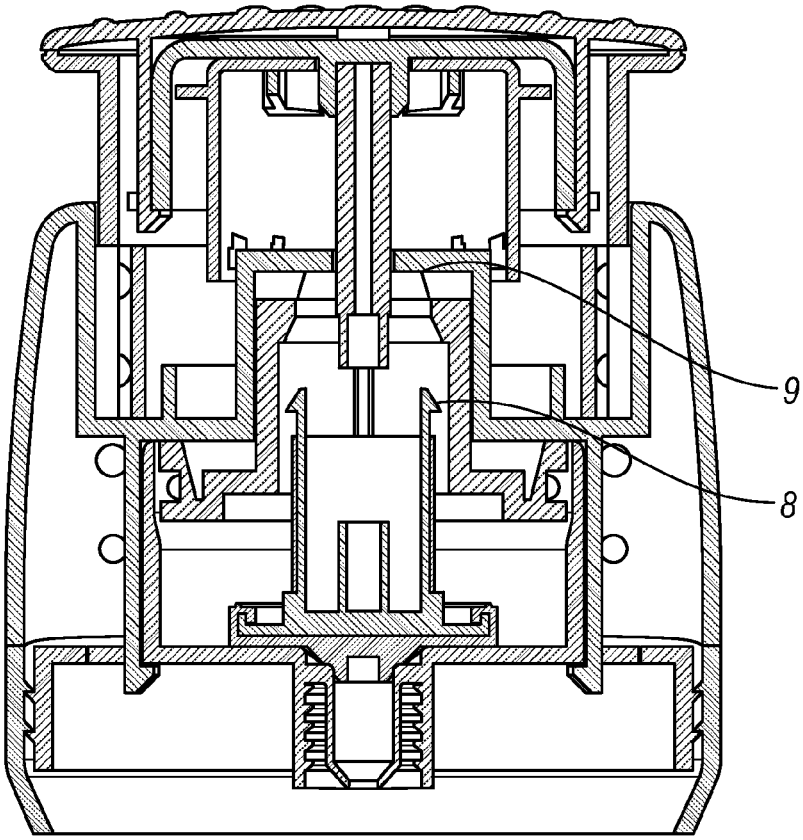
Figure 4A:
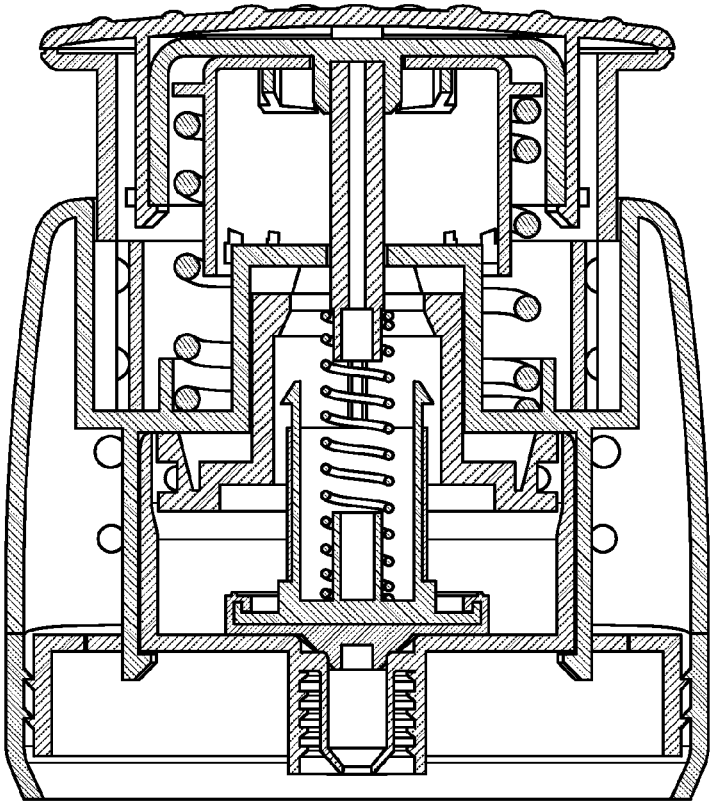
Figure 4B:
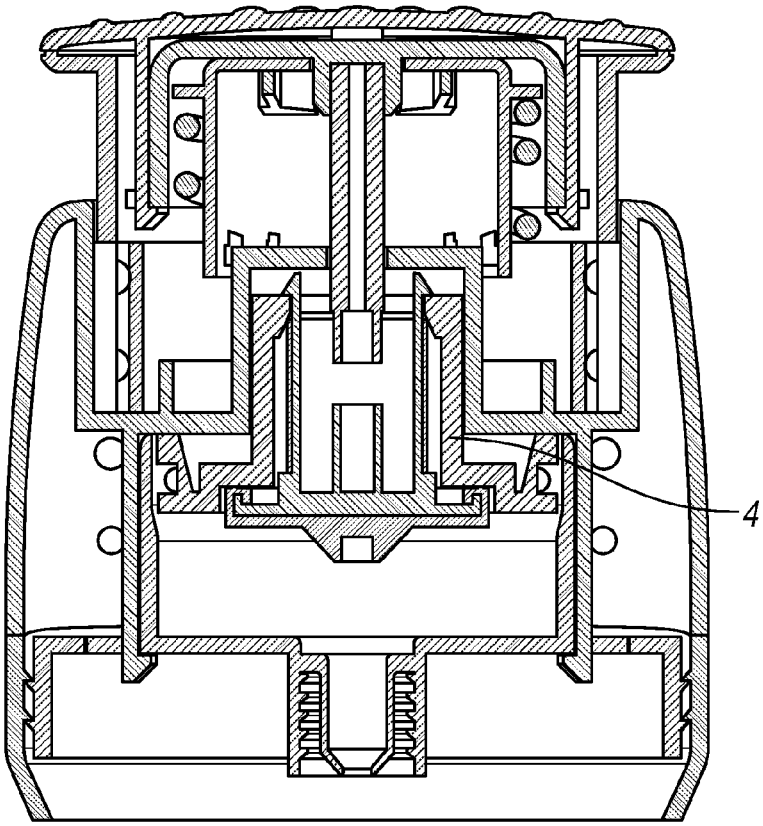
Figure 5:
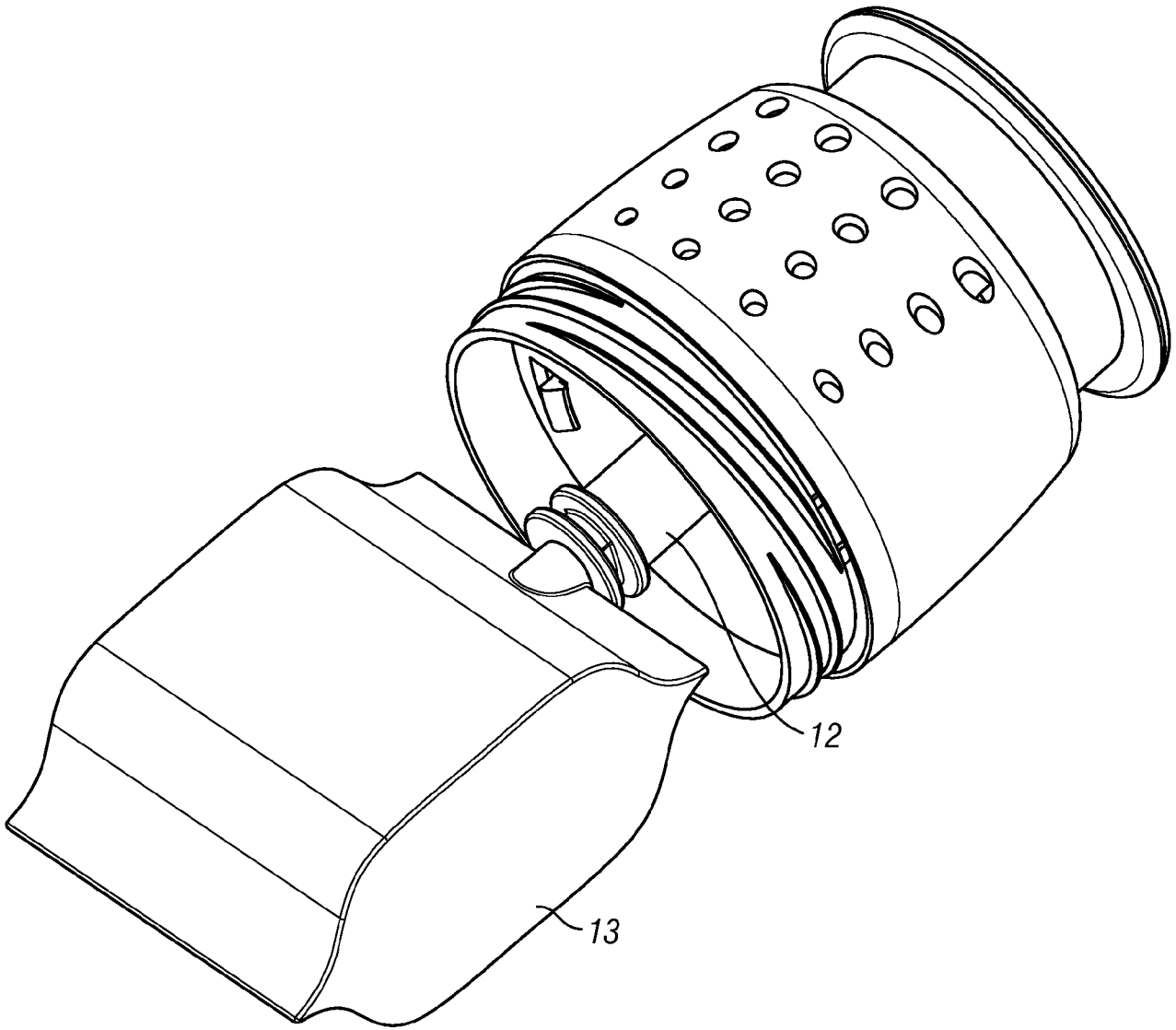
FIG. 5 shows a view of a partially dissembled device showing a refill pouch.
Figure 6:
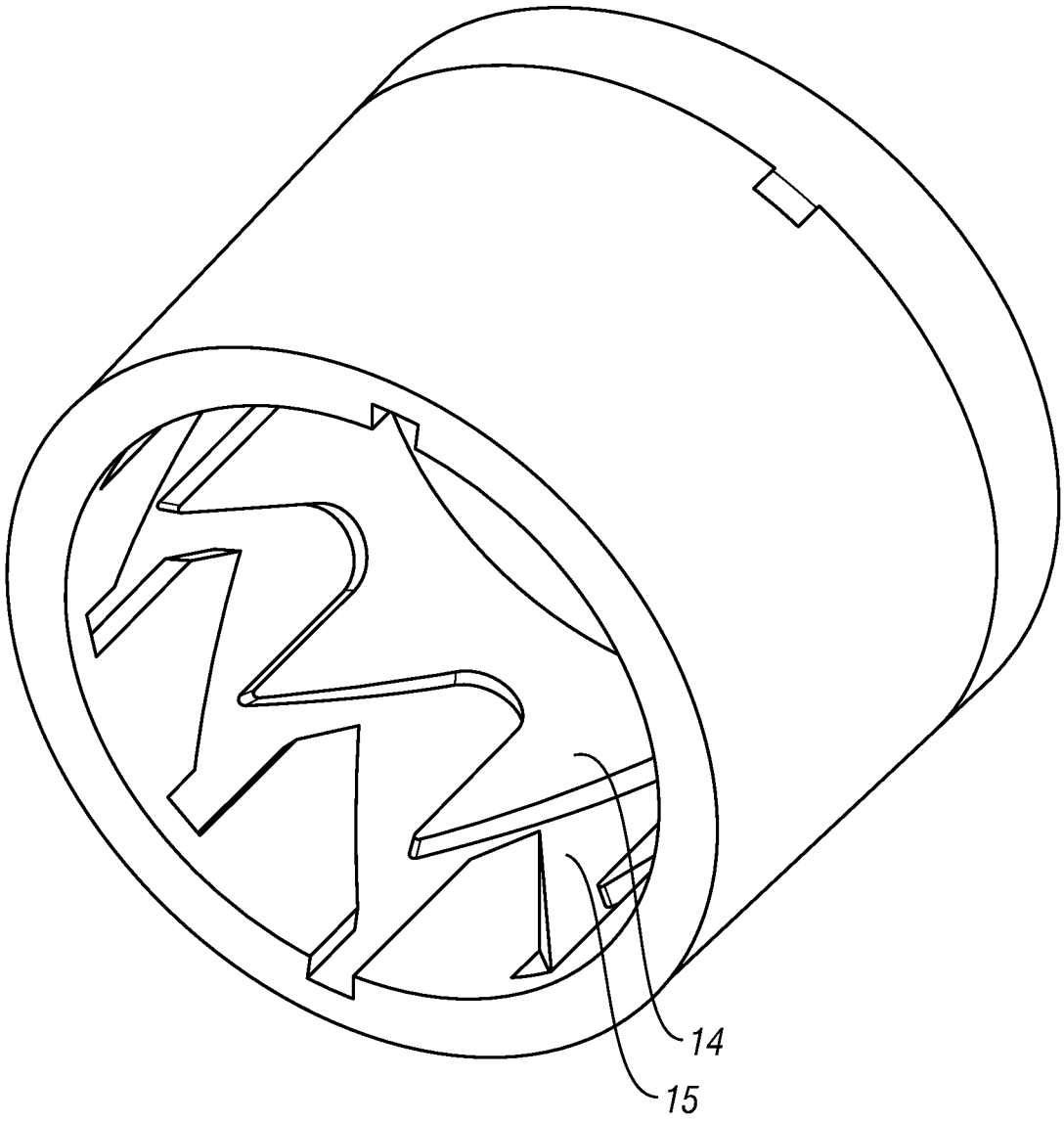
FIG. 6 shows a view of a partially dissembled device showing the indication means.

Referring particularly to FIGS. 3 & 4 the operation of the pump in use can be seen.

When activated the main piston body 4 is pushed against a piston bias spring 6 by a user from its initial position until it abuts against the end of the cylinder 3. At this point the main piston body 4 engages a plug 7 via hooking means 8 on the plug. (The plug 7 is used in its resting position to seal the primary chamber 1).

Then as the main piston body 4 moves back to its initial position it is able to pull the plug 7 away from its engagement and sealing of primary chamber 1. In the retreat of the main piston body 4 and the plug 7 the cylinder 3 is filled with detergent composition from the primary chamber 1.

As the main piston body 4 reaches its initial position the hooking means 8 is dis-engaged by contact with a disengaging member 9 arranged on the inside of the cylinder 3. The plug 7 is biased away from main piston body 4 by a biasing spring 10.

The detergent composition is then allowed to be released from the cylinder 3. The release is facilitated by virtue of the cylinder 3 having a conical flaring at the end furthest from the primary chamber 1. The conical flaring (widening) of the cylinder 3 means that the full bore of the cylinder 3 is not obscured by the main piston body 4. Instead there is a gap between the main piston body 4 and the bore of the cylinder 3 at the end furthest from the primary chamber 1. The presence of this gap allows the detergent composition to seep out of the cylinder 3 and/or (in use) wash liquor to seep into the cylinder 3 aiding/causing removal of the detergent composition from the cylinder 3 and through the secondary chamber 2 into the main volume of wash liquor.

The main piston body 4 has an operating cap 5 which has a viewing window 11 to allow a user to see how many times the device has been operated.

To refill the device the primary chamber 1 and the secondary chamber 2 may be separated, e.g. as shown here by unscrewing the primary chamber 1 from the secondary chamber 2. When this is done a fluid conduit 12 of the primary chamber 1 is exposed to which a user can refit a new detergent containing pouch 13. After fitment the device can be re-assembled by screwing the primary chamber 1 to the secondary chamber 2.

To allow a user to see how many times the device has been operated the device includes a counter wheel which is arranged adjacent a portion of the cylinder 3. The counter wheel is in the form a disc, whereby a portion of the counter wheel is viewable by a consumer through the viewing window 11. The counter wheel operation is driven by an associated drive tube 14 which co-operates with a portion of the cylinder 3, e.g. such as one or more extensions/teeth (not shown). The drive tube includes a recessed pathway 15. On depression of the piston cap 5 the drive tube is pressed down so that the extensions/teeth engage the recessed pathway 15. By the arrangement of the recessed pathway, this engagement causes a rotation of the drive tube 14 and the counter wheel.

The invention claimed is:

1. A detergent composition dispensing device which is removably insertable into a washing machine, the device comprising:

(a) a primary chamber adapted to accommodate a detergent composition, (b) a secondary chamber, from which the detergent composition is released into the wash liquor of the washing machine, (c) a mechanism for transferring detergent from the primary chamber to the secondary chamber, the mechanism comprising:

(i) a moveable piston disposed within the secondary chamber (ii) a moveable plug arranged between the primary chamber and the secondary chamber, the plug is independently moveable with respect to the moveable piston and which, when operated, is a valve which permits flow of the detergent composition from the primary chamber and the secondary chamber (d) a cap operable by a user and a first biasing spring which biases the cap in a direction away from the movable plug, and;

(e) a second biasing spring which biases the moveable plug away from a main piston body.

2. A device according to claim 1, adapted for use in an automatic laundry washing machine.

3. A device according to claim 1, wherein the moveable piston is manually operated.

4. A device according to claim 3, wherein the movable piston comprises:

a main piston body and, the moveable plug.

5. A device according to claim 4, wherein the movable plug is attachable to the main piston body by a resilient hooking means.

6. A device according to claim 5, wherein the moveable plug is biased away from the main piston body by a biasing means.

7. A device according to claim 4, wherein the main piston body is biased towards a first position by a biasing means.

8. A device according to claim 4, wherein the main piston body comprises a cylinder having a flaring at the end furthest from the primary chamber.

9. A device according to claim 1, which has a cap operable by a user.

10. A device according to claim 9, wherein the cap has an indication means to show a user how many times the cap has been operated.

11. A device according to claim 1, wherein the detergent composition is in the form of a liquid.

12. A device according to claim 11, wherein the detergent composition is refillable into the primary chamber.

13. A device according to claim 12, wherein the detergent composition is refillable by replacement of a pouch containing detergent within the primary chamber.

14. A device according to claim 1 which further comprises:

a disengaging member which disengages hooking means of the moveable plug.

* * * * *